United States Patent [19]

Shimazaki

[11] Patent Number: 4,794,319

[45] Date of Patent: Dec. 27, 1988

[54] GLASS MOUNTED ANTENNA

[75] Inventor: Tetsuo Shimazaki, Tokyo, Japan

[73] Assignee: Alliance Research Corporation, Chatsworth, Calif.

[21] Appl. No.: 881,602

[22] Filed: Jul. 3, 1986

[51] Int. Cl.[4] ..... H01Q 1/32

[52] U.S. Cl. ..... 343/715; 343/712; 343/745; 343/711

[58] Field of Search ..... 343/715, 712, 745, 711, 343/749

[56] References Cited

U.S. PATENT DOCUMENTS 4,238,799 12/1980 Parfitt ..... 343/745
4,658,259 4/1987 Blaese ..... 343/715

FOREIGN PATENT DOCUMENTS 0137391 4/1985 European Pat. Off. ..... 343/715

*Primary Examiner*—William L. Sikes
*Assistant Examiner*—Hoanganh Le
*Attorney, Agent, or Firm*—Kleinberg, Marvin H.; Jodziewicz, Matthew F.

[57] ABSTRACT

A mobile transmitting and receiving communications antenna assembly for use on a vehicle, includes a primary radiating element a secondary radiating element having first and second radiating elements, normal to a longitudinal axis of the primary radiating element to form a ground plane therefor. Impedance matching means, comprising a tuned circuit tuned to the nominal resonant frequency of the capacitively loaded antenna and electrically connected to the second electrically conductive coupling member in the immediate proximity thereof to resonate in conjunction with said primary radiating element. The impedance matching means displaying an impedance which varies between a first impedance at the connection to the second electrically conductive coupling member which is substantially equal to the impedance at the base end of the primary radiating element and a second impedance at least several orders of magnitude less than the first impedance. Means for connecting transmission line means to the impedance matching means at a point where the impedance of the impedance matching means is substantially equal to the impedance of the transmission line.

In a first embodiment the primary and secondary radiating elements are mounted on opposite sides of a dielectric panel such as a window which capacitively couples the primary radiating element to the transmitter and/or receiver. In an alternative embodiment, the primary and secondary radiating elements are commonly mounted to the interior surface of a dielectric panel.

19 Claims, 4 Drawing Sheets

GLASS MOUNTED ANTENNA

BACKGROUND OF THE INVENTION

1. Field of the Invention

The present invention relates to antennas for transceiver apparatus and more particularly to an antenna for cellular telephone frequencies that is adapted to be mounted to a window of a vehicle.

2. Description of Related Art

It has long been known that an antenna can be mounted on a pane of glass and that the dielectric properties of the glass can be advantageously be used to capacitively couple the antenna to the radio apparatus when they are on opposite sides of the glass. The patent to J. A. Rostron, U.S. Pat. No. 1,715,952, issued June 4, 1929 taught a window mounted antenna that was capacitively coupled through the window to a transmitting or receiving apparatus.

With the popularity of radios in automobiles, several early inventors patented antennas which were mounted on vehicular windows or windshields. Typical of these are the patents to M. Diamant, French Patent No. 1.314.455, issued Dec. 3, 1963, the German patents to P. L. R. Eaubonne, No. 25 43 973, issued Apr. 8, 1976, and to A. C. R. Braglia, No. 25 38 290, issued Apr. 29, 1976, and the U.S. Pat. No. 4,089,817 to D. Kirkendall.

More recently, a patent was issued to D. L. Parfitt, U.S. Pat. No. 4,238,799, issued Dec. 9, 1980 which reflected the strong interest in citizens band radios which had achieved great popularity and were in widespread use. The antenna disclosed therein was an electrically shortened, inductively loaded half wave antenna adapted to be installed on a non-conductive surface of a vehicle. The electrically shortened half-wave antenna was chosen because of the unavailability of a ground plane which would permit the use of the more desirable, quarter-wave length ground plane antenna.

In recent years, the cellular telephone has become an extremely popular accessory item in vehicles. The cellular telephone is a transceiver operating in a frequency range of from 820–895 MHz. At these frequencies, one wavelength can be approximately one foot, thereby allowing virtually any antenna length to be chosen.

BRIEF SUMMARY OF THE INVENTION

With the modern emphasis on styling, it has been deemed desirable to have an antenna that can be mounted unobtrusively on a vehicle surface without the need to drill holes in the body. Further, many vehicles include large panels of non conductive materials such as plastic and fibreglass upon which an antenna could be mounted. In both instances, such a placement of an antenna would isolate the antenna from a ground plane which makes unavailable a preferred antenna design.

It has been found that "grounded" antennas or antennas mounted in close proximity to a ground plane can have improved performance in terms of radiation pattern and in terms of efficiency of the radiating elements. Moreover, if an antenna is operated in the current feed mode, the presence of a ground plane improves the impedance matching characteristics of the antenna with respect to the coaxial cable that couples the antenna to the transceiver.

According to the present invention, a ground plane is generated at the antenna by adding a pair of quarter-wave stubs or "radial" antennas at right angles to the antenna. The stubs are aligned in a straight line which creates an effective "ground" plane orthogonal to the linear axis of the antenna. The main antenna is capacitively connected to the transmission line through the non conducting surface. The stubs are commonly connected to the ground or return line.

In a preferred embodiment of the invention, the main antenna is a $\frac{5}{8}$ wave segment combined with a $\frac{1}{4}$ wave segment and separated by an inductive phasing coil. The main antenna is mounted to the exterior of the vehicle. On the interior, a, trimmer capacitor serially connected to a first inductor couples to the signal line of the coaxial cable that leads to the transceiver. A second inductor couples the ground connection to the signal line.

In alternative embodiments, the ground is coupled to the signal line through a second trimmer capacitor. The alternative has proven to be less effective than the preferred embodiment, but does operate and therefore is included for completeness.

In yet a different variation of the present invention, it has been found that a suitable antenna can be designed that can be wholly mounted on a non conductive surface within the interior of a vehicle, preferably a window or front or rear windshield. For this embodiment, a $\frac{1}{2}$ wave main antenna is combined with a pair of orthogonally extending $\frac{1}{4}$ wave stubs. As in the preferred embodiment, the main antenna is connected through a variable capacitor to the signal line and the stubs are connected to the ground line. A reactive element, either an inductor or capacitor, couples the ground and signal lines.

A more detailed description of a mobile transmitting and receiving communications antenna assembly for use on a vehicle, constructed in accordance with the present invention disclosed herein, follows. A primary radiating element having a first elongated, substantially five-eighths wavelength radiating section and collinear therewith, a second elongated, substantially one-quarter wavelength radiating section.

The primary radiating element forms an inductance means disposed between and electrically coupled to the first and second radiating sections. A first electrically conductive tuning and loading member is electrically connected to and disposed adjacent a base end of the primary radiating element.

The electrically conductive tuning and loading member is mounted on a first side of a non-conductive body portion of the vehicle. A second electrically conductive coupling member is mounted on a second opposite side of the non-conductive body portion in substantial juxtaposition with the first electrically conductive tuning and loading member. The first and second electrically conductive members define with the non-conductive body portion, a coupling capacitor at the base end of the primary radiating element and is located adjacent a current node thereof.

A first and a second radiating element, each substantially one-quarter wavelength in length, and electrically coupled with the primary radiating element form a ground plane therefor. The first and second radiating elements are normal to a longitudinal axis of the primary radiating element.

Impedance matching means, comprising a tuned circuit tuned to the nominal resonant frequency of the capacitively loaded antenna is electrically connected to the second electrically conductive coupling member in the immediate proximity thereof to resonate in conjunction with the primary radiating element. The impedance matching means displays an impedance which varies between a first impedance at the connection to the second electrically conductive coupling member and which is substantially equal to the impedance at the base end of the primary radiating element and a second impedance at least several orders of magnitude less than the first impedance. Means for connecting transmission line means to the impedance matching means at a point where the impedance of the impedance matching means is substantially equal to the impedance of said transmission line is also provided for by the invention.

BRIEF DESCRIPTION OF THE DRAWINGS

Further advantages and features of the present invention will be more fully apparent to those skilled in the art to which the invention pertains from the ensuing detailed description thereof, regarded in conjunction with the accompanying drawings wherein like reference characters refer to like parts throughout and in which.

DESCRIPTION OF THE PREFERRED EMBODIMENTS

Figure 1:
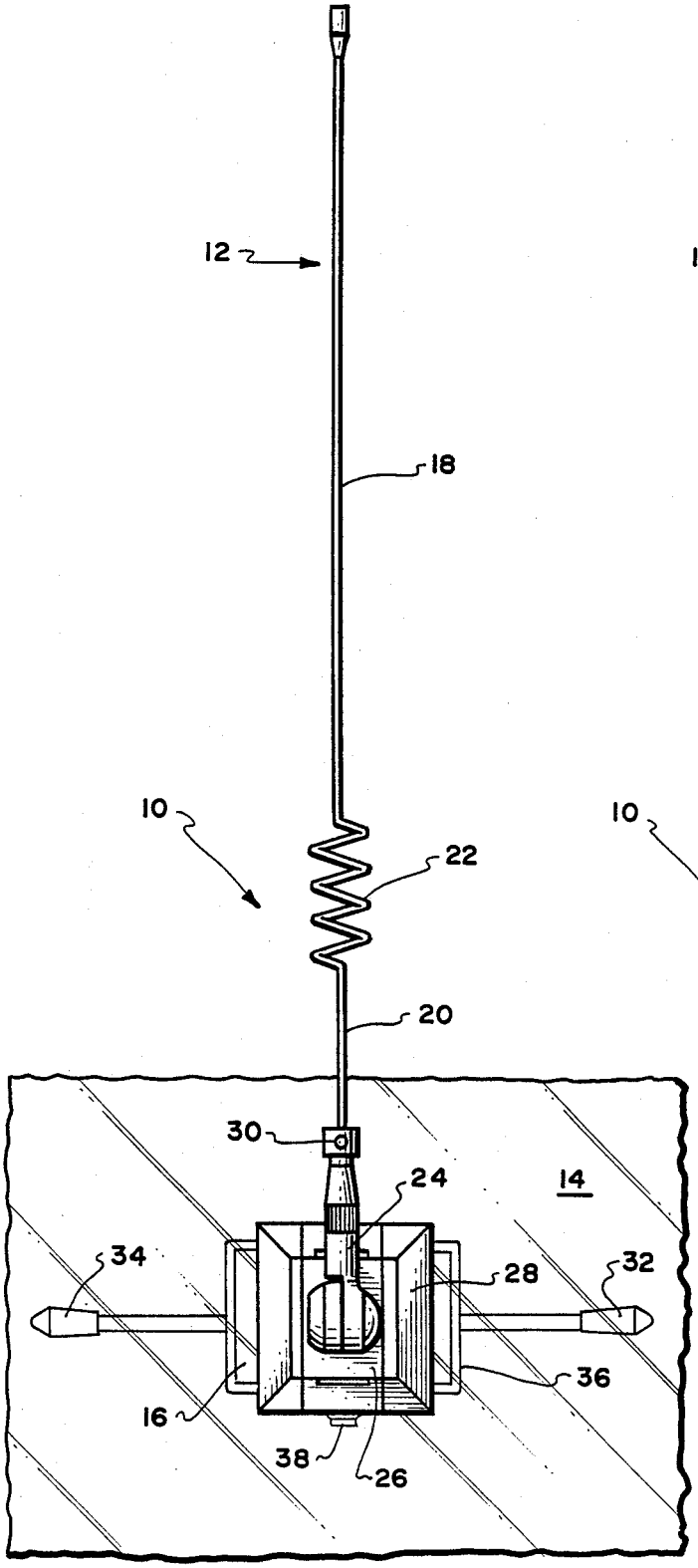
FIG. 1 is a front view of a preferred embodiment of the glass mounted antenna of the present invention.
Figure 2:
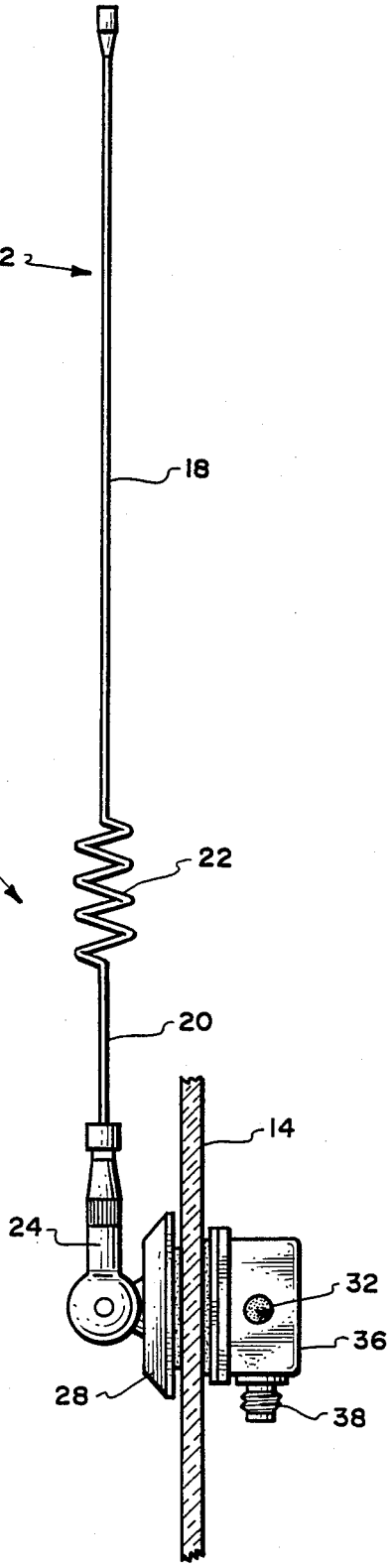
FIG. 2 is a side view of the antenna of FIG. 1.

Turning first to FIGS. 1 and 2, there is shown a glass mounted antenna 10 in which the primary antenna element 12 is mounted on the exterior of the glass 14 and the coupling and tuning circuit elements 16 are mounted on the interior surface of the glass 14. It is understood that although the invention is shown as being mounted on opposite sides of a glass pane, the antenna would function equally well if the material separating the elements were any other dielectric such as a plastic panel.

The invention is ideally suited for use with motor vehicles and can be used on the windshield, the back light or any glass or plastic panel. In this preferred embodiment, only the primary antenna element 12 is on the exterior of the vehicle. The remaining elements are on the interior where they can be directly connected to a transceiver through a conventional coaxial cable.

As seen in FIG. 1, the primary antenna element 12 is made up of a $\frac{5}{8}$ wave segment 18 and a $\frac{1}{4}$ wave segment 20, separated by an inductive phasing coil 22. The primary antenna element 12 is mounted in a housing 24 that is pivotally connected to an exterior base member 26 that is adapted to be adhered to the surface of the glass 14. A plastic shroud or bezel 28 surrounds the base member 26 and serves only a decorative function. To permit some versatility and limited tuning within the designed frequency band, the primary antenna element 12 can move within the housing 24 and a set screw 30 locks the antenna element 12 at the optimum length.

Extending at right angles to a line parallel to the axis of the primary antenna element 12 are first and second stub antennas 32, 34. Each has an effective length of $\frac{1}{4}$ wave. The stub antennas 32, 34 are mounted on an interior base member 36 which is adapted to be adhered to the inner surface of the glass 14. The interior and exterior base members 36, 26 are designed to be matched in alignment when mounted since each is intnnded to be one plate of a capacitor which uses the glass 14 as the dielectric element.

As best seen in FIG. 2, the interior base member 36 includes a coaxial fitting 38 to which a coaxial cable (not shown) can be fastened that connects the antenna 10 to a transmitter receiver combination or transceiver (not shown). When radiating, the stub antennas function in a manner similar to a ground plane and reflect impinging energy into a desired radiation pattern. This permits the use of the $\frac{5}{8}$, $\frac{1}{4}$ wave combination in a most effective fashion.

Figure 3:
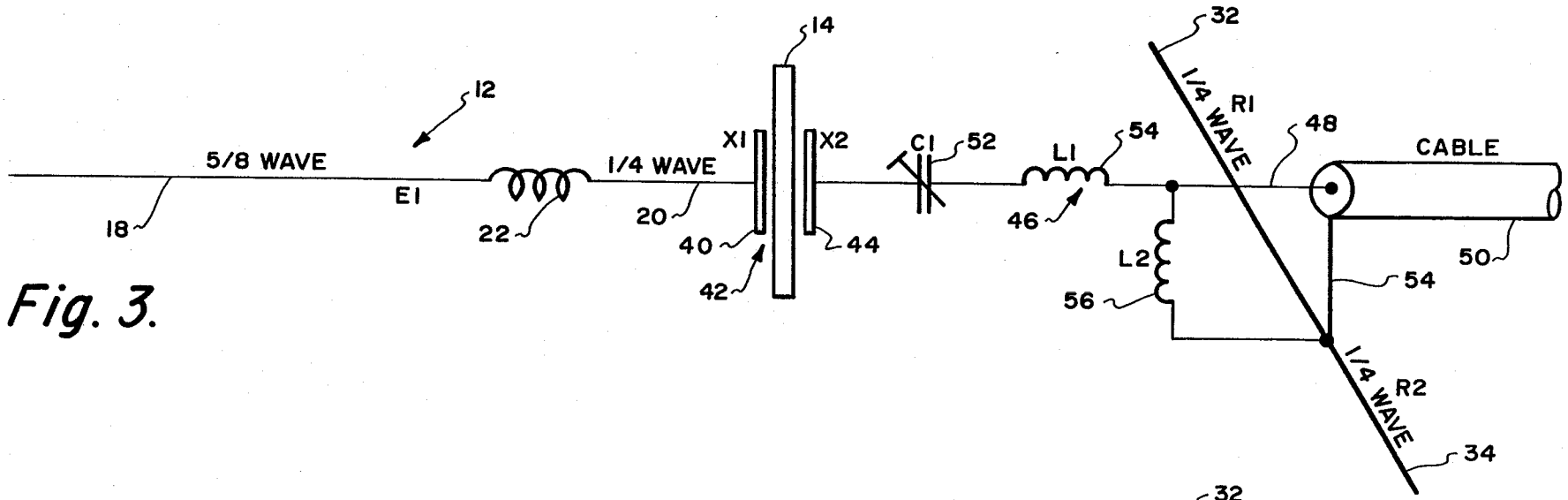
FIG. 3 is an idealized diagram of the circuit of the antenna of FIG. 1.

Turning next to FIG. 3, there is shown a preferred circuit for use with the antenna of the present invention. As shown, the primary antenna element 12 ia shown directly connected to one plate 40 of a capacitor 42, the other plate 44 of which is connected through a tuning circuit 46 to the signal lead 48 of a coaxial cable 50 that is coupled to a transceiver. The glass 14 to which the plates 40, 44 are adhered is the dielectric for the capacitor 42. An adjustable tuning capacitor 52 is serially connected to the "inside" plate 44, and may, for circuit purposes, be considered a "lumped" capacitive element.

In the preferred embodiment, a first inductor 54 serially couples the capacitors 42,52 to the signal lead 48. A second inductor 56 couples the signal lead 48 to the ground or shield 54 of the coaxial cable 50. The stub antennas 32, 34 are connected to the grounded shield 54, as well.

In use, the circuit is connected to a transceiver and a standing wave ratio meter is used in conjunction with the adjustable capacitor 52 to achieve peak performance in the 820–895 MHz band which has been assigned to cellular mobile telephone systems. The total capacitance (of the dielectric panel and the adjustable capacitor 52) functions to "cancel" the inductive reactance of the antenna.

The inductor 54, 56 are selected to match the impedance of the antenna circuit to the coaxial cable 50. Accordingly, energy can be transferred through the glass or other dielectric panel with a minimum of energy loss.

Because the antenna circuit is designed to operate in the current feed mode, the grounded stub antennas 32, 34 act as a "mirror image" of the primary antenna 12. In the absence of the grounded stub antennas, a reflection current would appear at the coaxial cable 50 and a good impedance match would be difficult, if not impossible to achieve.

In one commercially distributed version of a preferred embodiment of the invention, the antenna system exhibited a virtual standing wave ratio of less than 1.2:1 with very little radiation pattern distortion. The antenna was capable of achieving a gain of 3 dB over $\frac{1}{4}$ wave antenna which is especially useful for the receiver operation.

Figure 4:
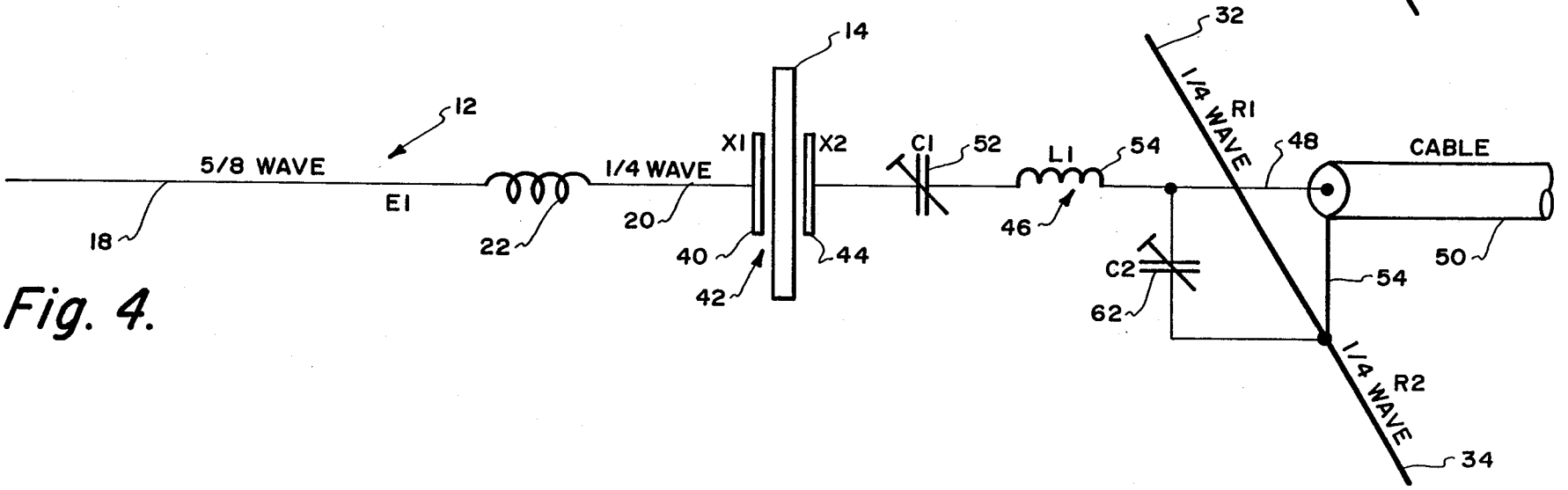
FIG. 4 is an idealized diagram of an alternative circuit for the antenna of FIG. 1.

FIG. 4 is an alternative circuit embodiment in which a second trimmer capacitor 62 is substituted for the second inductor 56. With this circuit, the optimum frequency range for which it is tuned tends to be quite sharp and narrow. Accordingly, it is not as satisfactory when dealing with a relatively broad frequency band such as the approximately 75 MHz bandwidth available in the 800 MHz band. However, for those applications where the frequencies in use fall within a fairly narrow band, the alternative embodiment should be satisfactory.

Figure 5:
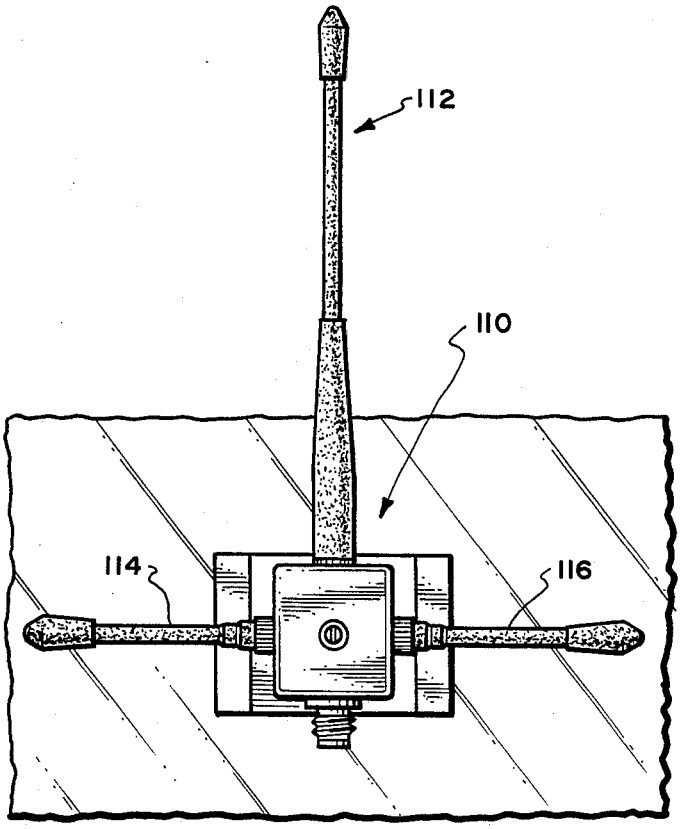
FIG. 5 is a front view of an alternative embodiment of a one piece, glass mounted antenna for interior mounting.

Turning next to FIG. 5, there is shown an alternative antenna system generally employing interior mounted stub antennas in which the principal antenna element is also mounted in the interior of a vehicle. In this embodiment, only a single base element is employed which can be fastened to virtually any interior surface and does not require an exteriorly mounted antenna element.

As shown, an interior mounted antenna system 110 includes a principal antenna element 112 which, in the preferred version is a ½ wave "rubber duck" type which is an electrically shortened, inductively loaded "whip". As in the embodiment of FIGS. 1 and 2, this antenna assembly utilizes two, aligned ¼ wave stub antennas 114,116 which are also of the "rubber duck" or electrically shortened type of antenna.

As in the preferred embodiment, the stub antennas 114,116 are orthogonally aligned with the linear axis of the principal antenna element 112 and act as a ground plane for the antenna circuit. It has long been known that a "grounded" ½ wave antenna can be quite effective and efficient.

Figure 6:
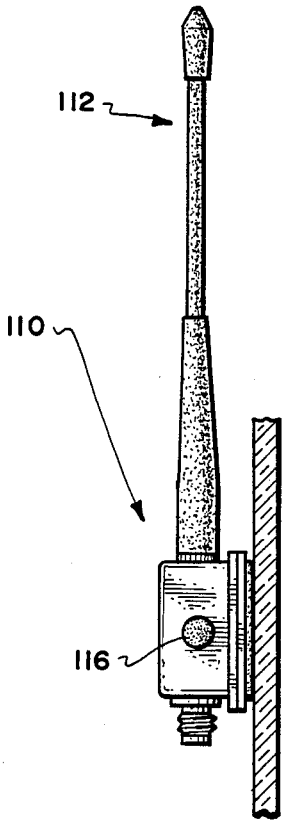
FIG. 6 is a side view of the antenna of FIG. 5.

FIG. 6 is a side view of the antenna illustrated in FIG. 5, and illustrates how stub antennas 114 and 116 are mounted with respect to the mounting surface.

Figure 7:
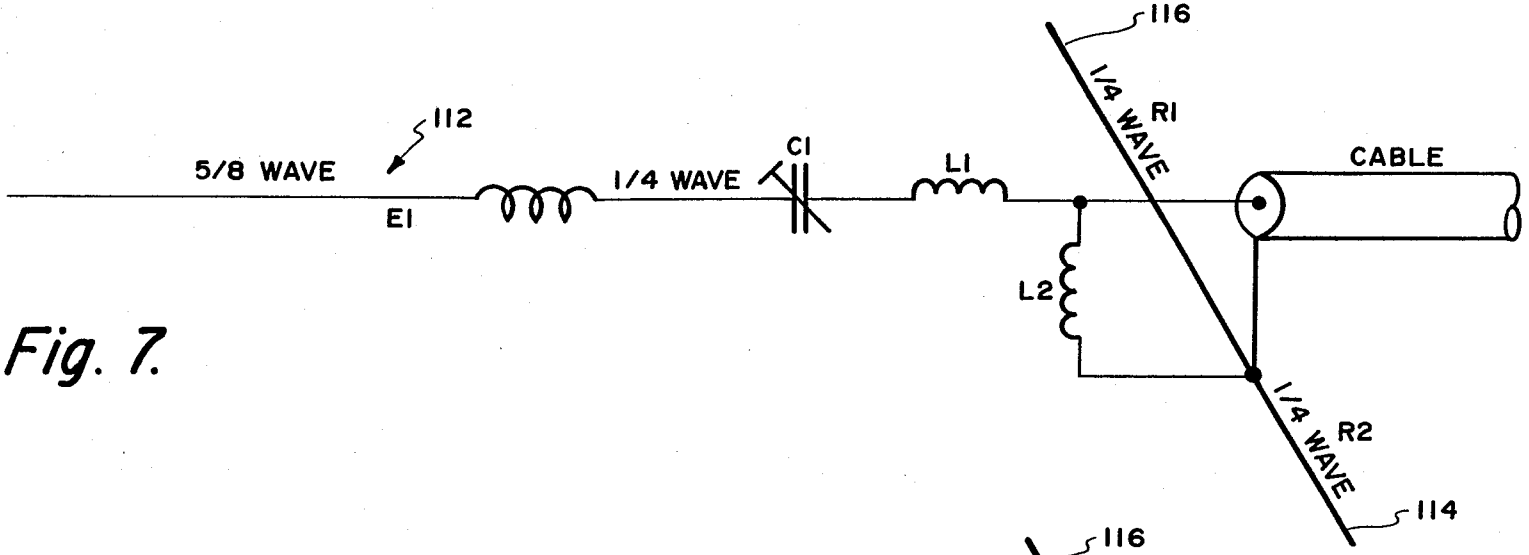
FIG. 7 is an idealized diagram of a circuit for the antenna of FIG. 5.
Figure 8:
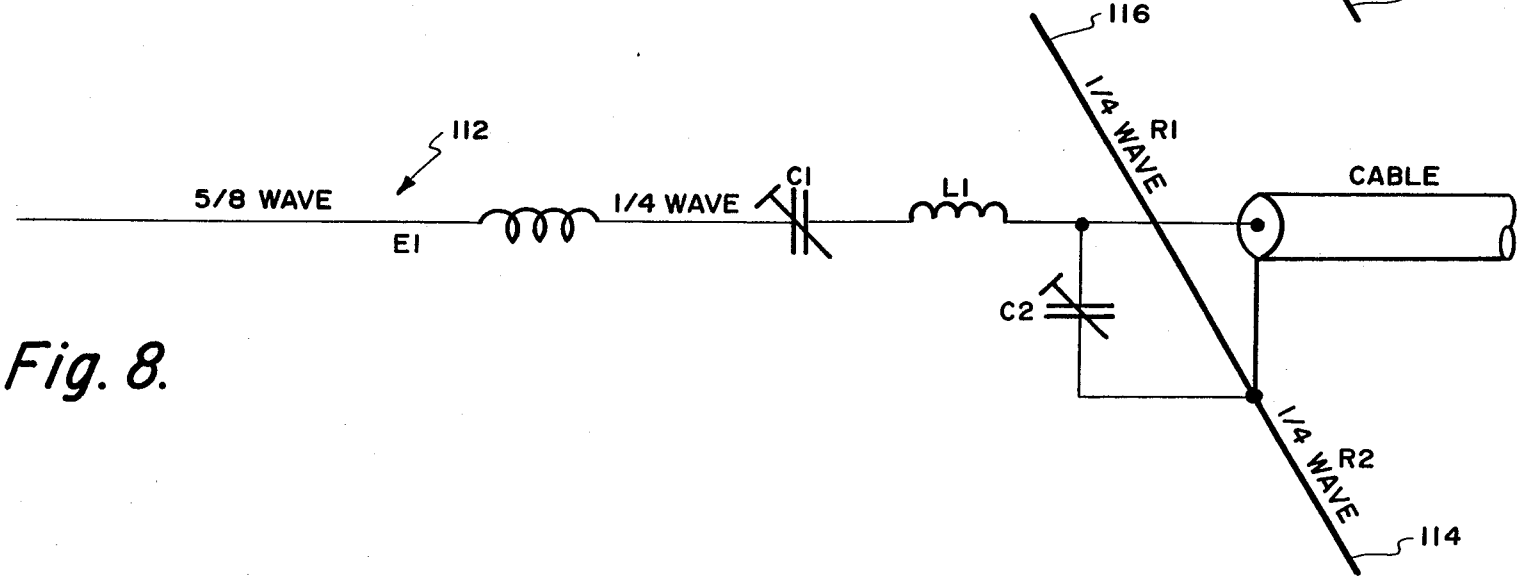
FIG. 8 is an alternative circuit for the antenna of FIG. 5.

FIG. 7 and FIG. 8 are similar to FIG. 3 and FIG. 4, respectively and illustrate the general electrical connections of the antenna assembly illustrated in FIG. 5 and FIG. 6.

The invention described above is, of course, susceptible to many variations, modifications and changes, all of which are within the skill of the art. It should be understood that all such variations, modifications and changes are within the spirit and scope of the invention and of the appended claims. Similarly, it will be understood that it is intended to cover all changes, modifications and variations of the example of the invention herein disclosed for the purpose of illustration which do not constitute departures from the spirit and scope of the invention.

I claim:

1. An antenna system for use with a transceiver including:

a primary radiating element of at least one-half wavelength of the frequency of interest;

first and second quarter wave elements adjacent the base of said primary radiating element and orthogonally aligned therewith to create a ground plane therefor, said quarter wave elements electrically connected to a source of common potential;

coupling means adapted to connect said radiating element and said quarter wave elements to the transceiver through a coaxial cable; and tuning means including reactive elements between said radiating element and the transceiver circuit for matching the impedance between said radiating element and the coaxial cable.

2. An antenna system as in claim 1, above, wherein said primary radiating element is adapted to be mounted on one side of a non-conducting, dielectric panel and said tuning and coupling means are mounted to the opposite side of said panel and in capacitive connection with said radiating element.

3. An antenna system as in claim 2, above, wherein said non-conducting, dielectric panel is glass.

4. An antenna system as in claim 2 above, wherein said first and second quarter wave elements are mounted on said tuning and coupling means.

5. An antenna system as in claim 1, above wherein said radiating element is one half wavelength at the principal radiating frequency of the transceiver circuit.

6. An antenna system as in claim 1, above wherein the radiating element includes a five-eighths wavelength section at the principal radiating frequency of the transceiver circuit.

7. An antenna system as in claim 6 above, wherein said radiating element includes a one-quarter wavelength radiating section separated from said five-eighths wavelengths section by inductive means.

8. An antenna system as in claim 7 above, wherein said inductive means comprises a helical coil formed from the primary radiating element.

9. A mobile transmitting and receiving commuications antenna assembly for use on a vehicle in UHF frequencies at least as high as 800 MHz, comprising:

a primary radiating element having a first elongated, substantially five-eights wavelength radiation section and collinear therewith, a second elongated, substantially one-quarter wavelength radiating section, said primary radiating element including an inductance means disposed between and electrically coupled to said first and second radiating sections;

a first electrically conductive tuning and loading member electrically connected to and disposed adjacent a base end of said primary radiating element, said electrically conductive tuning and loading member breing mounted on a first side of a non-conductive body portion of said vehicle;

a second electrically conductive coupling member mounted on a second, opposite side of said non-conductive body portion in substantial juxtaposition with said first electrically conductive tuning and loading member, said first and second electrically conductive members defining with said non-conductive body portion a coupling capacitor having a fixed plate surface area at the base end of said primary radiating element and located adjacent a current node thereof;

first and second secondary radiating elements, each substantially one-quarter wavelength in length electrically coupled with said primary radiating element forming a ground plane therefor, said first and second secondary radiating elements being normal to a longitudinal axis of said primary radiating element;

impedance matching means comprising a tuned circuit tuned to the nominal resonant frequency of said capacitively loaded antenna and electrically connected to said second electrically conductive coupling member in the immediate proximity thereof to resonate in conjunction with said primary radiating element, said impedance matching means displaying an impedance which varies between a first impedance at said connection to said second electrically conductive coupling member which is substantially equal to said impedance at the base end of said primary radiating element and a second impedance that is at least several orders of magnitude less than said first impedance; and means for connecting transmission line means to said impedance matching means at a point where the impedance of said impedance matching means is substantially equal to the impedance of the transmission line means.

10. A mobile transmitting and receiving communications antenna assembly for use on a vehicle in accordance with claim 9, wherein said impedance matching means includes a user adjustable capacitance member.

11. A mobile transmitting and receiving communications antenna assembly for use on a vehicle in accordance with claim 9, further comprising:

transmission line means for connection between said antenna assembly and a radio communications unit, said transmission line means having an impedance that is orders of magnitude less than the impedance of said antenna assembly at the base end thereof.

12. A mobile transmitting and receiving communications antenna assembly for use on vehicle in accordance with claim 9, wherein said impedance matching means comprises a series tuned circuit tuned to the nominal resonant frequency of said antenna assembly.

13. A mobile transmitting and receiving communications antenna assembly for use on a vehicle in accordance with claim 9, wherein said base end of said primary radiating element and said first electrically conductive tuning and loading member are connecting so that said primary radiating element may be user adjusted, to remain generally vertical with regard to the earth's surface.

14. A mobile transmitting and receiving communications antenna assembly for use on a vehicle in accordance with claim 9, wherein said primary radiating element inductance means comprises a helical coil formed from the primary radiating element.

15. A mobile transmitting and receiving communications antenna assembly for use on a vehicle in accordance with claim 9, wherein said non-conductive body portion of said vehicle is a glass window.

16. A mobile transmitting and receiving communications antenna assembly for use on a vehicle in accordance with claim 9, wherein said non-conductive body portion of said vehicle is a fiberglass panel.

17. A mobile transmitting and receiving communications antenna assembly for use on a vehicle in accordance with claim 9, wherein said first and second radiating elements are physically connected to said second electrically conductive coupling member and are mounted on said second opposite side of said non-conductive body portion of said vehicle.

18. A mobile transmitting and receiving communications antenna assembly for use on vehicle in accordance with claim 9, wherein said first and second radiating elements are physically connected to said first electrically conductive tuning and loading member and are mounted on said first side of said non-conductive body portion of said vehicle.

19. A mobile transmitting and receiving communications antenna assembly for use on a vehicle in accordance with claim 9, wherein said first and second radiating, elements are generally horizontal with regard to the earth's surface.

* * * * *